United States Patent [19]

Woonton et al.

[11] 4,036,277

[45] July 19, 1977

[54] HIGH SPEED METHOD AND APPARATUS FOR PRODUCING FOUNDRY MOLDS

[75] Inventors: Kent Woonton, Kitchner, Canada; Jeffrey R. Short, III, Lincolnshire, Ill.; Kenneth N. Roach, Willowdale, Canada

[73] Assignee: J. R. Short Milling Co., Chicago, Ill.

[21] Appl. No.: 623,411

[22] Filed: Oct. 17, 1975

[51] Int. Cl.[2] ..... B22C 15/08

[52] U.S. Cl. ..... 164/16; 164/18; 164/187

[58] Field of Search ..... 164/12, 16, 18, 159, 164/187

[56] References Cited

U.S. PATENT DOCUMENTS

| | | | |
|---|---|---|---|
| 3,796,250 | 3/1974 | Woonton et al. | 164/161 |

FOREIGN PATENT DOCUMENTS

| | | | |
|---|---|---|---|
| 1,325,913 | 3/1963 | France | 164/16 |
| 367,610 | 6/1961 | Japan | 164/16 |
| 502,143 | 3/1971 | Switzerland | 164/16 |
| 812,352 | 4/1959 | United Kingdom | 164/12 |

*Primary Examiner*—Robert D. Baldwin

*Attorney, Agent, or Firm*—Roylance, Abrams, Berdo & Kaul

[57] ABSTRACT

In the production of foundry mold parts by the method described in U.S. Pat. No. 3,739,834, the production rate is increased by employing a foundry sand mix which can be cured by means of a gaseous curing agent and carrying out curing of the pressed mold part while the mold part is supported at the pressing station.

10 Claims, 7 Drawing Figures

HIGH SPEED METHOD AND APPARATUS FOR PRODUCING FOUNDRY MOLDS

BACKGROUND OF THE INVENTION

As disclosed in U.S. Pat. No. 3,739,834, issued June 19, 1973, in the names of Kent Woonton et al., foundry mold parts are produced at a high production rate by forming a continuous bed of a curable foundry sand mix, advancing the bed to a pressing station, forming the mold part by a pressing operation, and then curing the pressed mold part. Using a sand mix which retains adequate plastic flowability to be pressed over the time required to advance the bed to the pressing station, the method has heretofore required that the pressed mold part be moved away from the pressing station before being cured. The mold part is severed from the bed by the pressing operation and, for example, can be advanced to a curing station by the same mechanism employed to advance the bed of sand mix to the pressing station. As disclosed in U.S. Pat. No. 3,796,250, issued Mar. 12, 1974, in the names of Kent Woonton et al., it is advantageous to employ an endless conveyor belt to carry the bed of sand mix to the pressing station and to carry the pressed mold parts to the curing station.

While the method just referred to represents a substantial advance in the art, room for improvement has remained. Thus, the requirement for a separate curing station has tended to increase the overall apparatus cost and complexity, particularly when the nature of the curing operation is such that mechanical movements at the curing station must be coordinated in precisely timed relation to mechanical movements at the pressing station. Also, when the foundry sand mix is one which is cured by a gaseous curing agent, provision of a separate curing station tends to require use of relatively large volumes of the curing gas. Another difficulty which must be faced when the mold part is cured in a location separate from the pressing station is that the pressed but as yet not fully cured mold part must be moved without damaging the mold part, a requirement which dictates a relatively expensive support structure as well as, in some cases, a slower cycle time.

OBJECTS OF THE INVENTION

A general object of the invention is to improve foundry mold part forming methods and apparatus, of the type referred to, in such fashion as to allow both higher production rates and lower apparatus costs.

Another object is to simplify such methods and apparatus by carrying out the pressing and curing steps at the same station.

A further object is to eliminate from such methods and apparatus the need for accomplishing mechanical operations, such as closing of a curing chamber, in highly precise timed relation to the pressing operation.

Yet another object is to eliminate the need for moving the pressed mold part while the mold part is still in a relatively fragile, largely uncured state.

SUMMARY OF THE INVENTION

Broadly considered, method embodiments of the invention comprise establishing on a movable support, typically an endless conveyor belt, a bed of predetermined depth of a foundry sand mix which includes a curable binder material, moving the support to present the bed of sand mix at a forming station, laterally confining a portion of the bed and forcing a pattern into the laterally confined portion to press that portion into the form desired for the mold part, and passing a gaseous curing agent into the pressed portion of the sand mix while the same is still laterally confined and still engaged by the pattern to thereby cure the shaped mold part at least to such an extent that the mold part can be moved and handled without breakage or significant deformation. In especially advantageous embodiments, the movable support is a foraminous conveyor belt and the step of passing the gaseous curing agent into the formed mold part is accomplished by passing the gas through the conveyor belt into the mold part. Best results are obtained when the gaseous curing agent is supplied in a volume and over a period of time such that the mold part can be taken directly from the forming station and used in casting, without further treatment. In all embodiments, the forming step is completed before introduction of the gaseous curing agent commences, and the formed mold part is maintained laterally confined and in engagement with the pattern during the curing operation.

In order that the manner in which the foregoing and other objects are attained according to the invention can be understood in detail, particularly advantageous embodiments thereof will be described with reference to the accompanying drawings, which form part of the original disclosure hereof, and wherein.

GENERAL DESCRIPTION OF APPARATUS EMBODIMENT OF FIGS. 1-4

Figure 1:
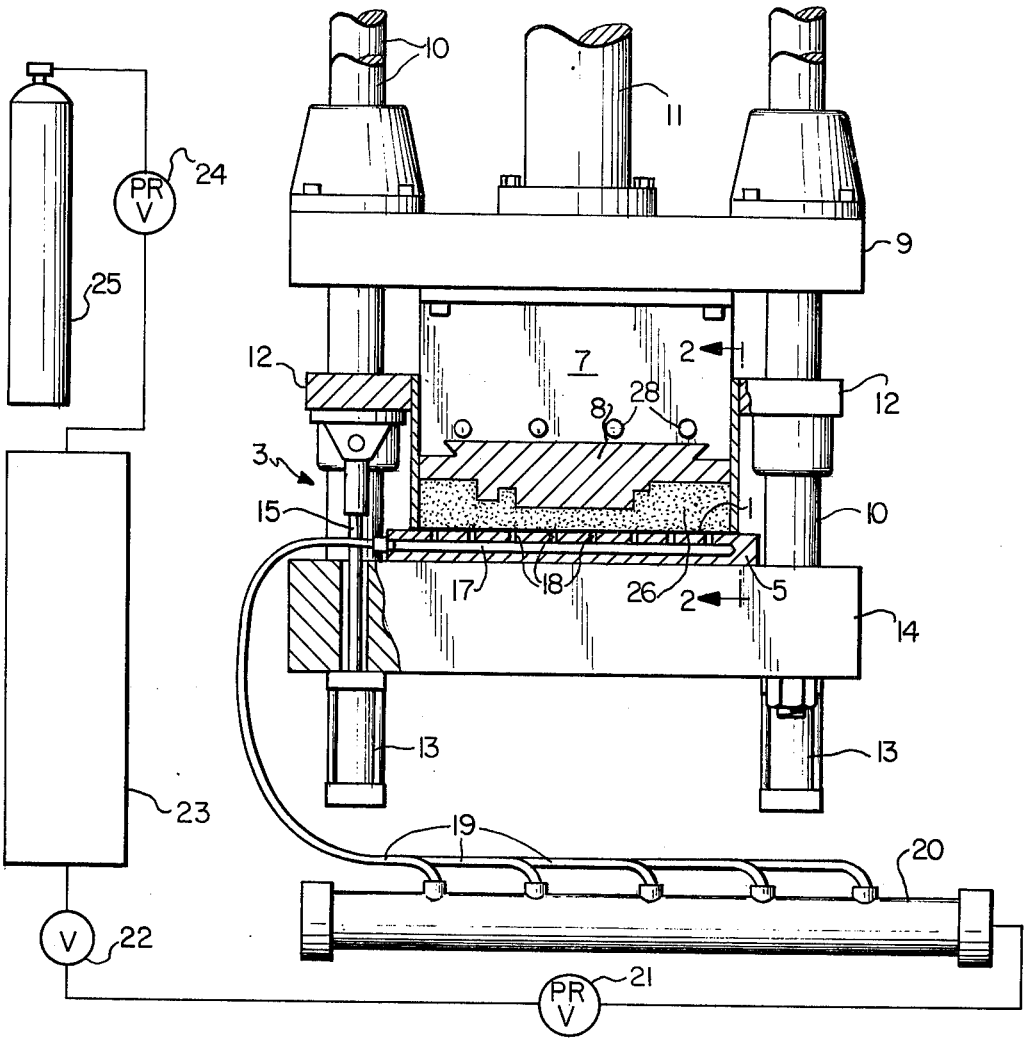
FIG. 1 is a semi-diagrammatic illustration of apparatus for carrying out the method acording to one embodiment of the invention.
Figure 2:
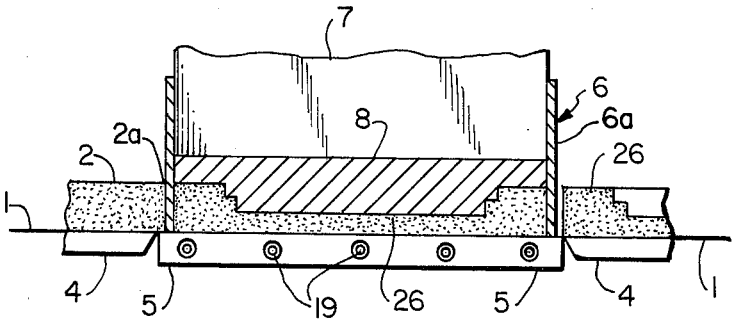
FIG. 2 is a fragmentary sectional view, taken generally on line 2—2, of FIG. 1.

Before describing method embodiments, the apparatus embodiment of FIGS. 1-4 will be described in order that the method can be understood more readily. The apparatus is broadly similar to that described in U.S. Pat. No. 3,796,250 but without the separate curing unit. Thus, the apparatus comprises a power driven endless belt 1 arranged so that the upper run of the belt extends horizontally and can convey a continuous bed 2, FIG. 2, of foundry sand mix from a point of deposition (not shown) to the forming station indicated generally at 3. The upper run of the conveyor belt is supported by stationary supports 4 before and after the forming station and, at the forming station, by a heavy horizontal plate 5. The forming or pressing apparatus comprises a rectangular shear box 6, two walls of which extend transversely across the conveyor belt and the other two walls of which extend each along a different edge portion of the belt, all of the walls lying in planes at right angles to the plane occupied by the upper run of the belt. Also included in the forming apparatus is a pattern carrier or platen 7 to which the pattern 8 is affixed. The platen is carried by a movable support 9 guided by four upright guide rods 10 and secured to piston rod 11 of a vertical hydraulic rectilinear power device (not shown) by which the pattern is forced downwardly into the sand mix bed. Shear box 6 is movably supported by frame members 12 guided by rods 10. Two hydraulic power devices 13 are each connected to a different one of members 12. Power devices 13 are mounted on and depend from the support block 14 which carries plate 5, the arrangement being such that simultaneous operation of power devices 13 to retract the piston rods 15 thereof is effective to drive shear box 6 downwardly into engagement with belt. Such downward movement of the shear box is independent of platen 7 and is effective to force the walls of the shear box through the bed 2 of sand mix and thus laterally confine a predetermined rectangular body of the sand mix. From comparison of FIGS. 1 and 2, it will be seen that shear box 6 is centered above plate 5 and is of such size and plan configuration that the lower edges of all four walls of the shear box oppose the upper face of plate 5. Power devices 13 are operated to lower the shear box into engagement with the belt preparatory to the pressing step, i.e., before platen 7 is driven downwardly.

Figure 3:
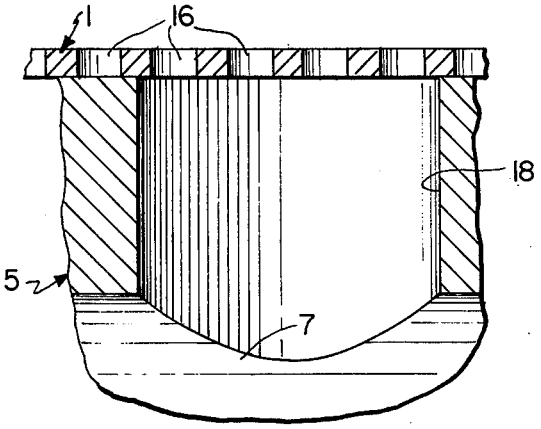
FIG. 3 is a fragmentary sectional view, greatly enlarged as compared to FIG. 1, the view being taken through a small portion of a conveyor belt and support member forming part of the apparatus of FIG. 1.

Advantageously, conveyor belt 1 is a stainless steel belt provided with a large number of small apertures 16, FIG. 3. Typically, the stainless steel belt can be 0.508 mm. thick, with the apertures 16 being circular and having a diameter of 0.8 mm., with there being 36 apertures per square cm., yielding an effective porosity of approximately 20% on a total area basis.

Plate 5 is rigidly mounted in centered relation below the forming apparatus and is rectangular in plan and so dimensioned that the plate extends beyond the confines of shear box 6. Plate 5 is provided with a plurality of horizontal bores 17 each of which communicate, as seen in FIG. 3, with a plurality of vertical bores 18. All of bores 18 open upwardly through the upper face 19 of plate 5, bores 18 being uniformly distributed throughout the rectangular area defined by the walls of shear box 6 when the shear box engages belt 1. The diameter of each bore 18 is large in comparison to the diameter of apertures 16 so that, as seen in FIG. 3, each bore 18 always communicates with a plurality of the apertures 16 of belt 1 regardless of the position of the belt during its travel over plate 5. Thus, bores 18 can typically have a diameter of approximately 6.3 mm. when the diameter of apertures 16 is 0.8 mm.

Each bore 17 is connected to a conduit 19, FIG. 1, which in turn is connected to a manifold 20.

Manifold 20 is connected via a pressure reducing valve 21 and an on-off valve 22 to an accumulator 23 which is supplied with the gaseous curing agent via a second pressure reducing valve 24 from a pressure tank 25.

With the gas pressure in tank 25 typically being 650–750 p.s.i. (45.7–52.7 kg. per sq. cm), pressure reducing valve 24 allows establishment of a large volume of gas in accumulator 23 at a relatively low pressure of, e.g., 60–70 p.s.i. (4.2–4.9 kg. per sq. cm.), and pressure reducing valve 21 allows a high gas flow rate at a working pressure of, e.g., 2–10 p.s.i. (0.14–0.7 kg. per sq. cm.).

Conveyor belt 1 is driven stepwise by any suitable drive mechanism, such as that disclosed in U.S. Pat. No. 3,796,250, in such fashion that each step of movement of the belt 1 will move the leading edge 2*a,* FIG. 2, of the bed of sand mix to a position aligned with the surface of wall 6*a* of the shear box which faces the advancing bed, it being understood that, by action of power devices 13, the shear box 6 is raised to a position above the sand mix bed before the belt is operated. After each step of movement of the belt, devices 13 are operated to drive shear box 6 downwardly against the belt, and platen 7 is then driven downwardly by piston rod 11 to force pattern 8 into the body of sand mix confined by coaction of the shear box and belt. The curing gas is then supplied to the pressed mold part 26, via conduits 19, bores 17 and 18, and apertures 16, to cure the mold part. Then, after valve 22 has been closed, piston rod 11 is raised to remove the pattern from engagement with the mold part, power devices 13 are operated to raise the shear box above the level of the sand bed, and belt 1 is advanced again to remove the completed mold part 26 from the pressing station and bring the leading portion of the sand mix bed 2 into position at the pressing station, as will be apparent from FIG. 2.

Figure 4:
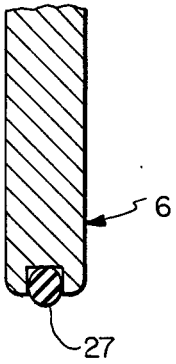
FIG. 4 is a fragmentary sectional view taken through a shear blade forming part of the apparatus of FIG. 1.

As seen in FIG. 4, the lower edge of each wall of the shear box 6 is advantageously provided with a downwardly opening groove accommodating a sealing strip 27 to form a relatively fluid-tight seal with belt 1 and thus minimize escape of curing gas from the shear box at the face of the belt. Escape of gas from the shear box is thus concentrated at the slidably engaged surfaces of the shear box and platen 7, and the leading portion of sand mix bed 2 upstream of the pressing station is not significantly affected by the curing gas.

When the pattern is to be heated, platen 7 is provided with bores each accommodating a conventional electrical cartridge heater 28, FIG. 1.

When relatively high rates of belt travel are employed, the metal belt 1 can be provided with a polymeric facing to afford additional frictional engagement between the belt and the sand mix.

Though perforated metal belts are particularly advantageous, woven belts of equivalent effective porosity are also suitable. For example, a conventional 2-ply, center bound, woven, untreated cotton belt 0.24 mm. in thickness and an average weight of approximately 1.25 kg. per 30 meters of length per 2.5 cm. of width has been successfully employed. In general, the porosity of the belt should be at least 15%, on a total area basis, to allow good gas flow rates into the pressed mold part.

GENERAL DESCRIPTION OF THE METHOD

The apparatus of FIGS. 1–4 is typical for carrying out the method.

The bed 2 can be formed continuously from a uniform mixture of foundry sand and any of the suitable binder formulations which can be cured with a gaseous curing agent. Thus, the binder material can be of the phenolic resin-polyisocyanate type, curable with gaseous tertiary amines such as trimethylamine or with liquid amines such as trimethylamine dispersed in a carrier gas such as nitrogen; or of the furfuryl alcohol-formaldehyde type, curable with chlorine gas, boron trifluoride, sulfur trioxide, hydrogen chloride gas, or boron trichloride; of the alkali metal silicate type, curable with carbon dioxide. Particularly advantageous binder materials are the aqueous alkali metal silicate materials having an alkali metal silicate content of at least 10% by weight and a silica-to-alkali-metal-oxide weight ratio of 0.5:1–5.1. Such materials include the aqueous sodium silicate materials containing at least 30% by weight sodium silicate and having an $SiO_2$:$Na_2O$ weight ratio of at least 2:1.

The binder material formulations are chosen to provide adequate plastic flowability to assure success of the pressing operation, and to retain that characteristic for a period of time long enough to allow the bed of sand mix to be established and advanced to the forming station. Typically, that period of time will be in the range of 1–5 min. When the polymeric or silicate binder material employed is one which does not itself provide adequate characteristics, additional additives such as cereal flours, partially dextrinized cereal flours, wood flour, fire clay, bentonite, fine sand, bank sand, silica flour, and iron oxide can be included.

When the binder material is an aqueous alkali metal silicate material, amounts in the range of 2–6% by weight, based on the weight of foundry sand in the mix, can be used. In general, amounts of binder material employed can range up to 10% based on foundry sand weight.

The initially continuous bed 2 of sand mix is advanced step-wise to the forming station 3, with each step of movement being adequate to bring the leading end portion of the bed beneath the forming apparatus. The shear box 6 is then forced downwardly into engagement with the conveyor belt, with the result that a portion of the bed of sand mix is cut off from the main body of the bed and laterally confined by the shear box and rigidly supported from below by the combination of plate 5 and belt 1. Pattern 8 is then pressed downwardly into the confined sand mix to form the same into the shape desired for the finished mold part.

The pattern can be pressed into the bed of sand mix with pressures ranging from as low as 10 p.s.i. to as high as 150 p.s.i. (0.7–10.55 kg. per sq. cm.), depending upon the size, thickness and complexity of the mold part to be produced. Particularly when using relatively high molding pressures, e.g., 100–130 p.s.i. (7–9.1 kg. per sq. cm.) it is advantageous to relieve the line pressure to the hydraulic pressing motor before commencing the curing gas flow, since doing so minimizes any tendancy for the mold part to adhere to the pattern during curing.

The gaseous curing agent is supplied via bores 17 and 18 coincidentally with completion of the pressing stroke, while the shear box 6 remains in contact with belt 1 and pattern 8 remains in engagement with the pressed sand mix and continues so engaged. A primary advantage of the invention is that it allows very high rates of mold part production. Thus, for example, using a sodium silicate type of binder, overall cycle times, i.e., the total time required to complete both the pressing operation and the curing operation and to then raise the pattern enough for removal of the finished mold part, of as low as 8 secs. have been achieved in making a mold part having a maximum thickness of 2 in. For larger mold parts, the invention provides significant advantages at cycle times up to, e.g., 65 sec. The total period of curing gas flow into the pressed sand mix can be in the range of 4–60 sec., depending upon the particular sand mix formulation and the size of the mold part.

Using a sodium silicate binder material at levels in the range of 2–6% of the foundry sand weight, and using commercial carbon dioxide gas as the curing agent, the rate of consumption of $CO_2$, and therefore the rate at which the curing gas is supplied to the pressed mold part, can be in the range of from about 2.5 to as much as 32 kg. per ton of sand mix, the upper limit being dictated by economics.

The following example is illustrative:

EXAMPLE 1

Using a conventional continuous foundry sand mixing apparatus, a sand mix comprising 3% aqueous sodium silicate, 2% partially dextrinized corn flour, and 0.5% water, based on the sand weight, was prepared. The sodium silicate employed had an $SiO_2$:$Na_2O$ weight ratio of 2.4:1, an $Na_2O$ content of 13.85% by weight, an $SiO_2$ content of 33.2% by weight, a density of 52° Be., and a viscosity of 2,100 cps. The sand mix was delivered to a supply hopper located above the endless belt of an apparatus constructed according to FIGS. 1–4 and was delivered by the hopper onto the belt to form a continuous bed of sand mix approximately 2.5 in. (6.35 cm.) in thickness. The endless belt employed was a 2-ply, center bound, untreated woven, white cotton belt 0.24 mm. thick. The belt had an average weight of approximately 1.25 kg. per 30 meters of length per 2.5 cm. of width. The shear box 6 of the apparatus had internal dimensions of 40.6 cm. transversely of the belt and 50.8 cm. longitudinally of the belt, so that the body of sand mix confined by the shear box had those plan dimensions. The main press was operated to force the pattern downwardly into the confined sand mix with a pressure of approximately 9.1 kg. per sq. cm. at the face of the pattern, the finished mold part having an edge thickness of approximately 5 cm.

Commercial $CO_2$ gas was employed as the curing agent, gas flow being commenced concurrently with completion of the pressing stroke and maintained for 6 sec. while the shear box remained in place and the pattern remained engaged with the pressed mold part. Pressure in the main press cylinder was relieved to reduce the pressure on the pattern during gas flow. Gas flow was maintained at the rate of approximately 16.5 kg. of $CO_2$ per metric ton of sand mix. At the end of the 6 sec. gassing period, the shear box and pattern were raised and the conveyor operated one step to advance the mold part 26 to the position seen in FIG. 2 and present a new portion of the sand mix bed 2 at the pressing station 3. The mold part 26 was found to be adequately cured for immediate use in casting metal and was thus adequately hard and strong to be safely handled manually or by automatic equipment.

In some cases, it is advantageous to modify the method by heating the pattern to a temperature in the range of 110°–325° C., so that curing of the shaped surface of the mold part is accelerated. Maintaining the pattern at such an elevated temperature assures that the shaped surface of the mold part will be cured to a very hard condition even when the total cycle time is reduced, with the gassing time being only a few seconds. Heating of the pattern is accomplished by providing horizontal bores in the pattern carrier of the press platen and inserting conventional electrical resistance type heating cartridges in the bores. In addition to improving the hardness and the precision of the shaped surface of the mold part, heating of the pattern reduces any tendancy for the mold part to stick to the pattern. The following example is illustrative:

EXAMPLE 2

The procedure of Example 1 was repeated, with the press platen equipped with four electric resistance cartridge heaters operated to maintain the pattern at a temperature of approximately 200° C. The sand mix contained 4.75% of the same aqueous sodium silicate employed in Example 1 and 0.47% of a conventional catalyst for the sodium silicate binder, i.e., the product marketed by Ashland Oil & Refining Co., Ashland, Kentucky, U.S.A., under the designation "Catalyst 3005". The total time of engagement of the pattern with the mold part at completion of the down stroke of the press was 15 seconds and gassing with $CO_2$ was carried out for the full 15 seconds at a pressure of 1.41 kg. per sq. cm. There was no observable tendancy for the mold part to stick to the pattern, and the finished mold part was found to be adequately cured throughout, but with a shaped surface portion approximately 3 mm. thick being especially precise and scratch-resistant.

Adequately cured mold parts, with especially hard shaped surfaces, are obtained when the procedure of Example 1 is duplicated precisely, but with the pattern maintained. at, e.g., 200° C. throughout the pressing and gassing steps.

THE APPARATUS OF FIG. 5

Figure 5:
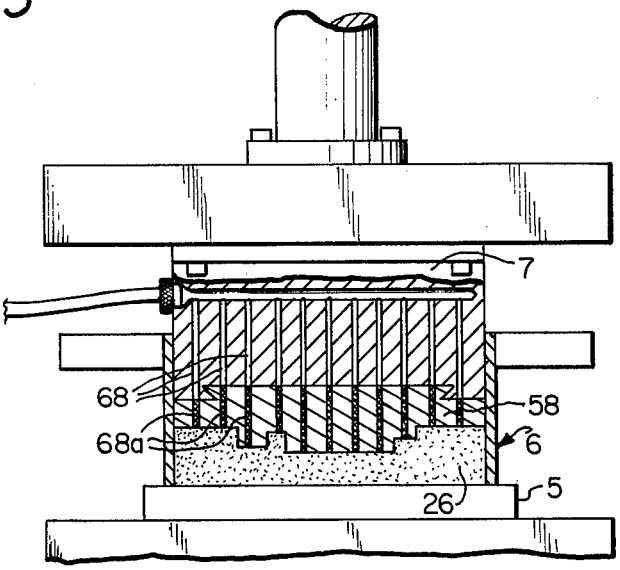
FIG. 5 is a view similar to FIG. 1 illustrating apparatus according to another embodiment of the invention.

FIG. 5 illustrates the apparatus of FIGS. 1–4 modified to provide for gassing of the pressed mold part via bores in the pattern rather than via apertures in the supporting conveyor. The apparatus remains the same as in FIGS. 1–4 except that platen 7 is provided with a plurality of horizontal bores 67 each of which communicates with a plurality of vertical bores 68 in the body of the platen, bores 68 opening through the face of the platen which is to be engaged by the pattern. Pattern 58 is provided with a number of vertical through bores 68*a* so arranged that each bore 68*a* registers with a different one of the bores 68 when the pattern is properly mounted on the platen. The open end of each bore 67 is connected to one of the conduits 19, FIG. 1, for supply of curing gas from the manifold. Bores 68*a* are packed, as with an expanded metal packing, to prevent entry of sand.

The lower platen or support plate 5 can be solid, without gas supply means, or can be constructed in the same manner shown in FIG. 1, in which case the curing gas is supplied to the bottom of the pressed mold part, inthe manner described with reference to FIGS. 1–4, as well as to the top of the mold part via bores 67, 68 and 68*a*.

THE APPARATUS OF FIG. 6

Figure 6:
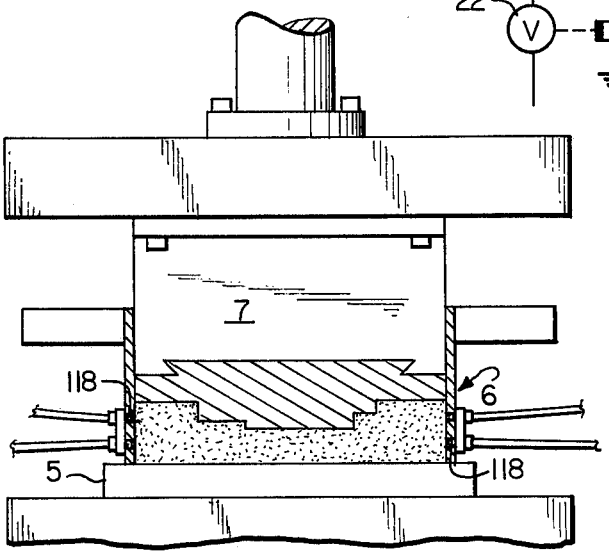
FIG. 6 is a view similar to FIG. 1 showing apparatus according to yet another embodiment.

FIG. 6 illustrates a modification of the apparatus of FIGS. 1–5 which provides for supply of the curing gas via bores in the plate which form the walls of the shear box. In the embodiment of FIG. 6, the apparatus remains the same as in FIGS. 1 and 2 except that the two side walls of shear box 6 which are parallel to the length of the conveyor are provided with a plurality of through bores 118 spaced apart over the area of the respective side wall which is to engage the pressed mold part. Each bore 118 is connected to one of the supply conduits 19, FIG. 1, from the manifold, so that the curing gas is supplied directly to the two sides of the pressed mold part via bores 118. Bores 118 are packed, as with expanded metal packing, to prevent entry of sand.

All of the curing gas can be supplied via bores 118. Alternatively, support plate 5 can be constructed as described with reference to FIG. 1 so that curing gas is also supplied upwardly through the conveyor belt, and the pattern can be constructed as described with reference to FIG. 5 for additional supply of curing gas downwardly through bores in the pattern.

THE MODIFICATION OF FIG. 7

Figure 7:
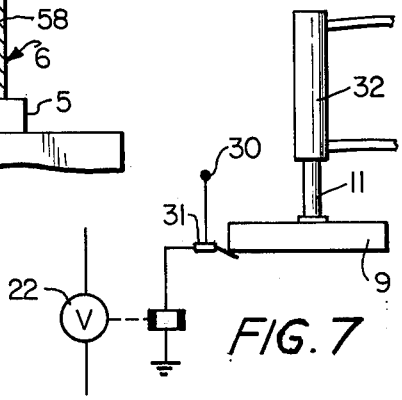
FIG. 7 is a schematic diagram illustrating a modification of the apparatus of FIGS. 1 and 2.

As illustrated in FIG. 7, flow of the curing gas to the pressed mold part can be commenced automatically in response to completion of the pressing stroke. Thus, with on-off valve 22 being a conventional solenoid operated valve, energized-open, the solenoid of the valve is connected to power terminal 30 via the normally open contacts of a conventional position switch 31 so located that its actuator is engaged by platen support 9 only at the end of the pressing stroke, with switch 31 being actuated to its closed position, energizing the solenoid to open valve 22, only when the down stroke of the press has been completed. In this embodiment, switch 31 remains closed, and valve 22 therefore remains open, until the power device 32 of the press is operated to raise the pattern carrier toward its inactive position preparatory to another cycle of operation.

It will be apparent to those skilled in the art that various changes and modifications can be made in the method and apparatus, without departing from the scope of the invention as defined in the appended claims.

We claim:

1. A method for producing foundry mold parts, comprising preparing a foundry sand mix comprising binder material which can be cured by a curing gas to render the mold part rigid;

depositing the sand mix upon an endless foraminous conveying member to form on the conveying member a bed of sand mix of predetermined depth;

moving the conveying member to present a portion of the bed of sand mix at a forming station at a time when the sand mix is characterized by adequate plastic flowability for forming and the binder material retains a curing potential adequate for rigidification of the formed mold part;

supporting the conveying member and said portion of the bed of sand mix at the forming station and forming said portion into the shape desired for the mold part by pressing a pattern into said portion with a pressure of 10–150 p.s.i. toward the conveying member while laterally confining said portion;

passing a gaseous curing agent through the foraminous conveying member into the formed portion of sand mix while the pattern is in engagement therewith and said portion is still laterally confined and thereby curing the shaped mold part to at least such an extent that the mold part can be moved and handled without breakage or significant deformation;

withdrawing the pattern from the shaped mold part so cured; and removing the mold part from the forming station by advancing the conveying member beyond the forming station.

2. The method according to claim 1, wherein the foraminous conveying member is a perforated metal conveyor belt.

3. The method according to claim 1, wherein the foraminous conveying member is a woven fabric conveyor belt.

4. The method according to claim 1, wherein the binder material comprises an alkali metal silicate material;

the curing agent comprises carbon dioxide gas; and said step of passing the curing agent into the portion of sand mix is carried out to provide to said portion of sand mix a volume of carbon dioxide gas equal to at least 2.5 kg. of carbon dioxide per metric ton of sand mix in a time period not exceeding 60 seconds.

5. The method according to claim 1, and further comprising maintaining the pattern at an elevated temperature of at least 100°C. during the forming step and the step of passing the curing agent into the portion of sand mix.

6. The method according to claim 1, wherein the pressure on the pattern is relieved, without disengaging the pattern from the shaped mold part, before passing of the gaseous curing agent through the conveying member and the shaped mold part.

7. In a foundry mold part making apparatus of the type comprising endless horizontal conveyor means, means for depositing a foundry sand mix curable by a gaseous curing agent and forming a continuous bed of the sand mix on the conveyor means, and means for driving the conveyor means stepwise to advance the bed of sand mix toward a forming station in steps of equal length, the combination of an endless conveyor belt forming the conveying element of the conveyor means, said belt being foraminous and capable of passing curing gas when the gas is applied to one surface of the belt;

shearing and confining means mounted at the forming station for movement between an inactive position, in which movement of the sand mix bed is not impeded by the shearing and confining means, and an active position, in which the shearing and confining means engages the conveyor and laterally confines a predetermined portion of the sand mix bed;

support means located to rigidly support the combination of said portion of the sand mix bed confined by said shearing and confining means and the portion of the conveyor underlying said portion of sand mix bed, said support means comprising a rigid member having a flat face over which said belt runs;

a vertically movable pattern carrier mounted at the forming station in alignment with said portion of the sand mix bed confined by said shearing and confining means when the latter is in said active position;

power means connected to said pattern carrier and operable to move said pattern carrier toward said portion of the sand mix bed confined by said shearing and confining means to press the pattern into said confined portion and thereby form said portion of the sand mix bed into the shape desired for the mold part;

conduit means connectible to a source of curing gas under pressure; and supply means connected to said conduit means for supplying curing gas to the formed portion of the sand mix bed while said portion is confined by said shearing and confining means and engaged by the pattern carried by said pattern carrier, said rigid member of said support means having internal flow means, to which said conduit means is connected, and a plurality of discharge apertures communicating with said internal flow means and opening through said flat face to supply curing gas to the lower surface of the foraminous belt.

8. Apparatus according to claim 7, wherein the endless conveyor belt is a thin metal belt having a plurality of small apertures; and said discharge apertures in said rigid member are large in comparison to the small apertures of the metal belt.

9. Apparatus according to claim 7, wherein the endless conveyor belt is a woven textile belt.

10. Apparatus according to claim 7, and further comprising valve means for establishing curing gas flow through said supply means; and means for operating said valve means to cause such gas flow only after said power means has been operated to cause said pattern carrier to move into a position such that a pattern carried thereby will have formed the said severed portion of the sand mix bed into the shape desired for the mold part.

* * * * *